United States Patent [19]

True, Jr. et al.

[11] 4,020,644

[45] May 3, 1977

[54] WATER DELIVERY SYSTEM AND METHOD FOR FORMING SAME

[75] Inventors: Howard D. F. True, Jr., Fern Creek; Bob D. Merryman; Robert B. Gelbard, both of Louisville, all of Ky.

[73] Assignee: General Electric Company, Louisville, Ky.

[22] Filed: Jan. 10, 1974

[21] Appl. No.: 432,287

[52] U.S. Cl. ..... 62/340; 62/353; 62/DIG. 13; 165/136

[51] Int. Cl.[2] ..... F25C 1/00

[58] Field of Search ..... 62/340, 353, 66, DIG. 13, 62/449; 220/9 F, DIG. 9; 165/136

[56] References Cited

UNITED STATES PATENTS

| | | | |
|---|---|---|---|
| 1,830,060 | 11/1931 | Holbrook | 62/DIG. 13 |
| 1,916,032 | 6/1933 | Allyne | 62/449 |
| 2,239,109 | 4/1941 | Lundvall | 62/DIG. 13 |
| 2,270,407 | 1/1942 | Blood et al. | 62/DIG. 13 |
| 2,409,910 | 10/1946 | Stober | 220/9 F |
| 2,614,398 | 10/1952 | Goure | 62/DIG. 13 |
| 2,637,530 | 5/1953 | Janos | 165/136 |
| 2,644,316 | 7/1953 | Wyman, Jr. | 62/449 |
| 2,653,139 | 9/1953 | Sterling | 62/DIG. 13 |
| 2,878,658 | 3/1959 | Ullstrand | 62/449 |
| 2,955,442 | 10/1960 | Loewenthal | 62/353 |
| 2,967,408 | 1/1961 | Knight | 62/353 |
| 2,982,115 | 5/1961 | Wurtz et al. | 62/DIG. 13 |
| 3,014,350 | 12/1961 | Harle | 62/353 |
| 3,039,453 | 6/1962 | Andrassy | 165/136 |
| 3,727,427 | 4/1973 | Eyman, Jr. et al. | 425/440 |

*Primary Examiner*—William F. O'Dea
*Assistant Examiner*—Henry C. Yuen
*Attorney, Agent, or Firm*—Francis H. Boos

[57] ABSTRACT

An apparatus and method for forming a water delivery system for an automatic ice-forming element of a refrigeration apparatus. The refrigeration apparatus is formed of inner and outer spaced-apart cases with a holding element positioned between the cases in contact with a water supply line for maintaining said line in heat exchange relationship with at least one wall of the outer case.

2 Claims, 2 Drawing Figures

WATER DELIVERY SYSTEM AND METHOD FOR FORMING SAME

BACKGROUND OF THE INVENTION

This invention pertains to an improved water supply system for an automatic ice-forming apparatus of a refrigeration apparatus.

U.S. Pat. No. 3,727,427-Eyman et al discloses an automatic ice-forming apparatus within a freezing compartment of a refrigeration apparatus. That refrigeration apparatus has inner and outer spaced-apart cases with insulating material positioned in the space formed between said cases. In that patent, the water supply line is held in heat exchange relationship with the outer case only by the foam insulation. In that construction, sufficient forces can be subjected on the water line by the foam during the formation thereof to displace the line and resultingly insulate the line from the outer case.

The present invention is specifically directed to apparatus and method for constructing a water delivery system for the ice-forming apparatus which is easy to install and, after installation, has improved assurance of preferred temperature control of water passing therethrough from a water supply source into the automatic ice-forming apparatus.

SUMMARY OF THE INVENTION

In accordance with the illustrated embodiment of the present invention, there is provided an apparatus and method for forming a water delivery system for an automatic ice-forming element of a refrigeration apparatus. The refrigeration apparatus is formed of inner and outer spaced-apart cases with a preformed insulating holding element contacting and maintaining a water supply line in heat exchange relationship with at least one wall of the outer case.

BRIEF DESCRIPTION OF THE DRAWINGS

With reference to the accompanying drawings.

DESCRIPTION OF THE PREFERRED EMBODIMENT

Figure 1:
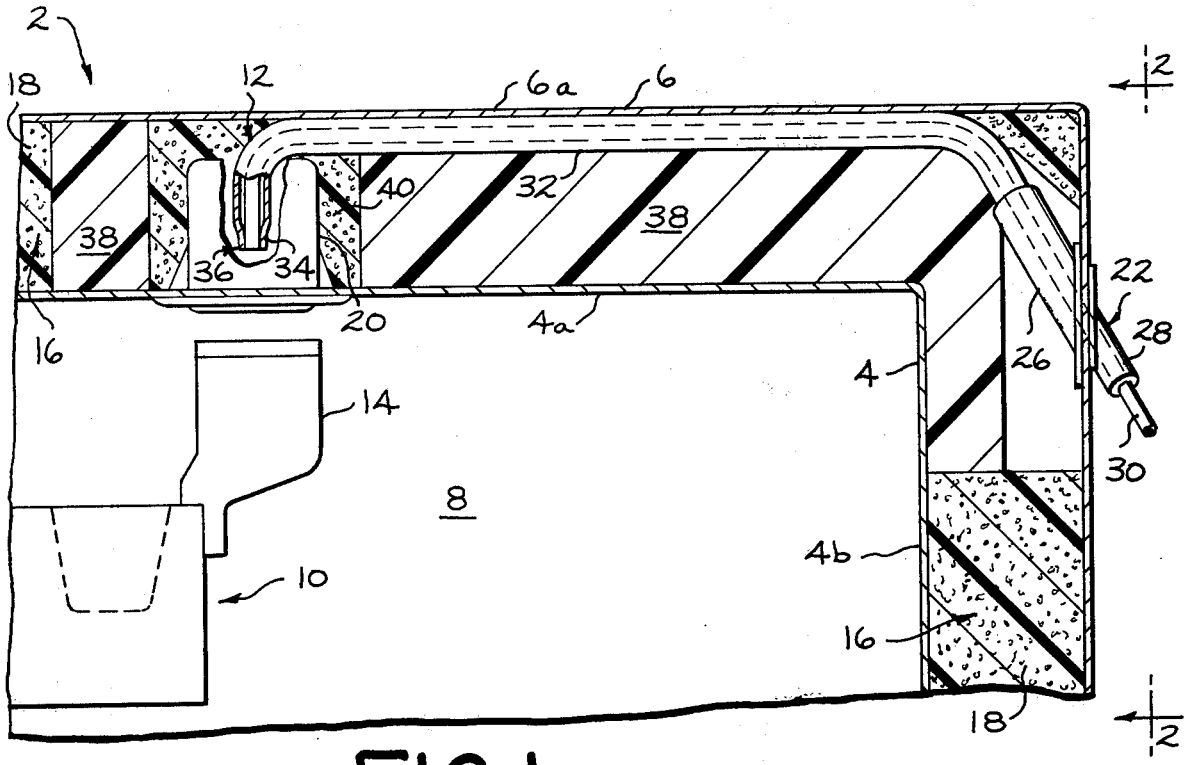
FIG. 1 is a diagrammatic, partially sectioned side view of a portion of a refrigeration apparatus having an automatic ice-forming element associated with the improved water delivery system of this invention.
Figure 2:
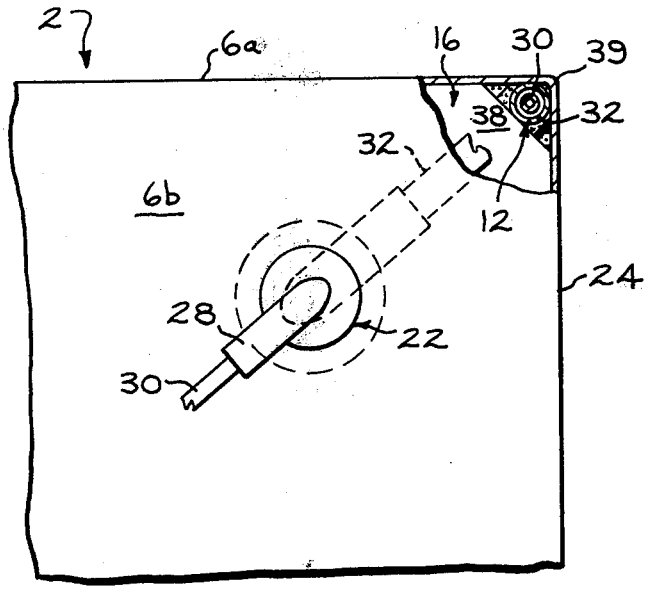
FIG. 2 is a diagrammatic, partially sectioned rear view of a portion of the refrigeration apparatus of FIG. 1.

Referring to FIGS. 1 and 2, the refrigeration apparatus 2 has inner and outer spaced-apart cases 4, 6, a freezing compartment 8 defined by at least a portion of the inner case 4, an automatic ice-forming apparatus 10 positioned within the freezing compartment 8, and a water supply line 12 associated with a water receiving element 14 of the ice-forming apparatus 10.

As is well known in the art, the inner and outer cases 4, 6 are each formed of a plurality of walls, for example top and back walls 4*a*, 4*b*, and 6*a* (FIG. 1), 6*b* (FIG. 2), and a space 16 (FIG. 1) is formed between said cases 4, 6. Space 16 is generally filled with a conventional insulating material 18 such as foamed polyurethane material.

A grommet 20 is preferably installed through the inner case 4 at a location adjacent and overlying the preselected location of the water receiving element 14 of the ice-forming apparatus 10. Another grommet 22 is preferably installed through the outer case 6, through one of the side walls, for example 24, or preferably a back wall 6*b*.

Grommet 22 preferably has first and second ends 26, 28 and extends through the outer case 6 with the first end 26 being positioned within the space 16. The first end 26 of the grommet 22 is connected to one end of a water supply line 12 and the other end of said water supply line is connected to grommet 20 with said water supply line 12 extending through the space 16.

It should be understood that the term "water supply line" used herein can be a single water supply line and associated grommets 20, 22 but is preferably a composite line comprising an inner tube 30, an outer tube 32, and said associated grommets 20, 22 in order that the outer tube 32 can be installed during manufacturing, with the ice maker and associated inner tube 30 thereafter being easily attached if desired.

In the preferred embodiment, the water supply line 12 comprises two concentric tubes with the outer tube 32 having a non-linear configuration and being formed of metal and the inner tube 30 being of a material having a flexibility sufficient to be inserted through said non-linear outer tube 32, such as for example polyethylene, polypropylene, vinyl, etc.

A seat 34 can be formed on the discharge end portion 36 of the outer tube 32 for contacting and maintaining the inner tube 30 within the outer tube 32 and directed toward the water receiving element 14. The seat 34 can be an annular seat in contact with the inner tube 30 about the outer periphery thereof.

A holding element 38 is positioned within the space 16 adjacent a portion of the outer tube 32 and in contact therewith. The holding element 38 is of a construction for contacting at least a portion of the water supply line or outer tube 32, urging at least a portion of the outer tube 32 into contact with at least one wall, for example wall 6*a* of the outer case 6, and there maintaining said tube in heat exchange relationship with said outer case 6.

As shown in FIG. 2, the water supply line or outer tube 32 is maintained in contact with first and second abutting walls of the outer case 6, for example a top wall 6*a* and a sidewall 24 adjacent and along a preselected length of the juncture 39 of said abutting walls 6*a*, 6*b*.

The water supply line or outer tube 32 is maintained in contact with the outer case 6 over a preselected outer tube length sufficient to prevent freezing of water within the outer tube 32 at the preselected operating temperatures of the freezing compartment 8 and the expected temperature of the outer case 6. Generally, under normal operating conditions, the refrigeration apparatus will be maintained within a household, and the temperature of the outer case 6 will be maintained in the range of about 65°–85° F, and the freezing compartment will be maintained in the range of about −10° F to about +5° F. One example of a length of contact of the outer tube 32 with the outer case 6 would, under these general conditions, be greater than about two inches.

The holding element 38 is preformed of insulating material and has a construction sufficient for substantially completely filling the space between the inner and outer cases 4, 6 adjacent the portion of the outer case contacted by the outer tube 32. Examples of the insulating materials from which the holding element 38 can be constructed are foamed polystyrene, urethane, or other rigid plastic foamed material.

In order to assure that the holding element 38 substantially completely fills the space 16 adjacent the water supply line and assures firm contact of the outer case 6 and outer tube 32, it is preferred that at least a portion of the holding element 38 is compressed between the inner and outer cases 4, 6 and that the holding element 38 be of a construction, for example an L configuration, wherein the holding element 38 can be placed upon a portion of the inner case 4 and supported thereby during assembly. Further, it is preferred that the holding element 38 encompass grommet 20 and is spaced from said grommet 20 in order that the foamed insulation 18 can enter and fill the annulus 40 formed between grommet 20 and the holding element 38.

In the method of this invention, grommets 20, 22 are preferably installed through their respective inner and outer cases 4, 6 at preselected locations thereon for receiving the ends of the outer tube 32. The holding element 38 is positioned in contact with the inner case 4, the outer tube 32 is installed in grommets 20, 22 and the outer case 6 is installed for positioning the holding element 38 within the space 16 between the inner and outer cases 4, 6 and in contact with the water supply line or outer tube 32 with said holding element 38 maintaining said water supply line or outer tube 32 in contact with at least one wall of the outer case.

Thereafter, foamable material is injected into the remaining space 16 between said inner and outer cases 4, 6, the foamable material is caused to foam, and preferably, thereby substantially completely fill the remaining space 16 for providing insulation between the inner and outer cases 4, 6.

It is preferred that the foamable material injected be an amount sufficient to fill at least a portion of the space between the inner and outer cases 4, 6 to an elevation at which the resultant foam is contacting the holding element 38.

In situ foaming of insulation is well known to those skilld in the art and various procedures and foamable materials can be utilized with this invention without departing thereform.

During assembly of the apparatus, or at some later time selected by the purchaser of the refrigeration apparatus, the automatic ice-forming apparatus 10 can be installed with its water receiving element 14 positioned adjacent the grommet 20 and the inner tube 30 can be inserted through the outer tube 32 and into contact with the seat 34. The other end of the inner tube 30 can then be connected to a water supply source (not shown) for supplying water to the automatic ice-forming apparatus 10.

By so constructing the apparatus of this invention, the water passing to the ice-forming apparatus is assured against freezing upstream of the water receiving element owing to the direct heat exchange relationship of the outer tube 32 with the outer case 6 and ambient temperatures. The holding element 38 assures contact of the outer tube 32 with the outer case 6 and maintains against displacement of the outer tube 32 from said outer case 6 in response to forces exerted on the outer tube 32 by the foam during foaming operations. Further, the preferred embodiment, comprising a composite water line, provides a construction whereby the inner tube 30 can be easily installed after foaming operations.

While there has been described a number of embodiments of the present invention, it is to be understood that the invention is not limited thereto and it is intended by the appended claims to cover all such modifications falling within the spirit and scope of the invention.

We claim:

1. In a refrigeration apparatus having inner and outer spaced-apart cases each having a plurality of walls, a freezing compartment defined by at least a portion of the inner case, an automatic ice-forming apparatus within the freezing compartment, a water supply line having an outer tube associated with the ice-forming apparatus and extending through the space between the cases, and insitu foamed insulating material in the space between the cases, the improvement comprising:

a holding element positioned between the cases adjacent the freezing compartment and in contact with the water supply line and the inner and outer cases, said holding element being an insulating material having a preformed configuration for maintaining said supply line in contact and heat exchange relationship along the outer case during foaming of and contact with the insitu foamed insulating material, wherein the outer tube is in contact with first and second abutting walls of the outer case adjacent the juncture of said walls.

2. An apparatus, as set forth in claim 1, wherein the holding element is of a configuration sufficient for substantially completely filling the space between the inner and outer cases adjacent the portion of the outer case contacted by the outer tube.

* * * * *